US006851997B2

(12) United States Patent
Carretti et al.

(10) Patent No.: US 6,851,997 B2
(45) Date of Patent: Feb. 8, 2005

(54) PROCESS FOR DEPOSITING CALCIUM GETTER THIN FILMS INSIDE SYSTEMS OPERATING UNDER VACUUM

(75) Inventors: Corrado Carretti, Milan (IT); Giorgio Longoni, Monza (IT)

(73) Assignee: SAES Getters S.p.A., Lainate (IT)

( * ) Notice: Subject to any disclaimer, the term of this patent is extended or adjusted under 35 U.S.C. 154(b) by 0 days.

(21) Appl. No.: 10/294,302

(22) Filed: Nov. 14, 2002

(65) Prior Publication Data

US 2003/0092347 A1 May 15, 2003

(30) Foreign Application Priority Data

Nov. 14, 2001 (IT) ..... MI2001A2408

(51) Int. Cl.[7] ..... H01J 9/00; H01J 9/38
(52) U.S. Cl. ..... 445/41; 445/55; 445/6
(58) Field of Search ..... 445/6, 9, 38, 41, 445/53, 55; 252/181.1, 181.4, 181.7; 417/48, 51

(56) References Cited

U.S. PATENT DOCUMENTS

| | | | |
|---|---|---|---|
| 2,842,640 | A | 7/1958 | Ragan |
| 2,907,451 | A | 10/1959 | Della Porta |
| 3,033,354 | A | 5/1962 | Della Porta |
| 3,225,911 | A | 12/1965 | Della Porta |
| 3,381,805 | A | 5/1968 | Della Porta et al. |
| 3,388,955 | A | 6/1968 | Della Porta et al. |
| 3,389,288 | A | 6/1968 | Della Porta et al. |
| 3,558,962 | A | 1/1971 | Reash |
| 3,669,567 | A | 6/1972 | Porta et al. |
| 3,719,433 | A | 3/1973 | Rabusin |
| 4,134,041 | A | 1/1979 | Della Porta et al. |
| 4,481,441 | A | 11/1984 | van Gils |
| 4,486,686 | A | 12/1984 | Della Porta |
| 4,504,765 | A | 3/1985 | Della Porta |
| 4,642,516 | A | 2/1987 | Ward et al. |
| 4,961,040 | A | 10/1990 | Della Porta et al. |
| 5,118,988 | A | 6/1992 | Della Porta |
| 5,865,658 | A | 2/1999 | Watkins |
| 6,042,441 | A | 3/2000 | Konuma |
| 6,071,080 | A | 6/2000 | Van Der Wilk et al. |

FOREIGN PATENT DOCUMENTS

| | | |
|---|---|---|
| EP | 0 686 990 A1 | 6/1995 |
| WO | WO 01/01436 | 1/2001 |

OTHER PUBLICATIONS

Turnbull, J.C., "Barium, strontium, and calcium as getters in electron tubes," J. Vac. Sci. Technology, vol. 14, No. 1, Jan/Feb. 1977, pp. 636–639.
International Search Report.

*Primary Examiner*—Nimeshkumar D. Patel
*Assistant Examiner*—Mariceli Santiago
(74) *Attorney, Agent, or Firm*—Perkins Coie LLP

(57) ABSTRACT

The present invention relates to a process for depositing a calcium getter thin film inside a system operating under vacuum. The process comprises the steps of introducing into the system under vacuum at least one evaporable getter device with an air-stable calcium compound. The system is evacuated until a pressure value $P_1$ is reached. The system is then heated up to the calcium evaporation temperature of the stable compound. The system evacuation continues until a pressure value $P_2$, which is lower than $P_1$, is reached and the system is sealed. In a preferred embodiment, the heating step separates the two evacuation steps.

8 Claims, 1 Drawing Sheet

PROCESS FOR DEPOSITING CALCIUM GETTER THIN FILMS INSIDE SYSTEMS OPERATING UNDER VACUUM

REFERENCE TO PRIORITY DOCUMENTS

This Application claims priority under 35 U.S.C. 119(a)–(d) to Italian Application No. MI2001 002408 filed Nov. 14, 2001, which is hereby incorporated by reference for all purposes.

FIELD OF THE INVENTION

The present invention relates to a process for depositing calcium thin films inside systems that operate under vacuum, in particular cathode ray tubes.

BACKGROUND

A number of industrial applications require a suitable vacuum level to be kept in a sealed space for a period of some years. For example, this is the case of cathode ray tubes, also known in the field as CRTs, which are used as television or computer screens. Vacuum is required in the CRTs in order to prevent the trajectory of the electrons emitted by the cathode from being deflected due to collision with gas particles. In order to prevent this, CRTs are evacuated in the manufacturing stage by means of mechanical pumps and then hermetically closed.

However, it is known that vacuum in the tube tends to decrease with time, above all due to degassing of the internal components of the tube itself. It is therefore necessary to use a getter material inside the tube, which is capable of binding the gas molecules and thus preserving the vacuum degree necessary for the desired functioning of the cathode ray tube. For these purposes, barium is commonly used. Recently, the applicant has also proposed the use of calcium, which when compared to barium has the double advantage of being less toxic (thereby causing less problems in the manufacturing and disposing steps of cathode ray tubes) and of generating a reduced quantity of X-rays, injurious to health, when hit from the electron beam.

Due to the high reactivity of these metals, which would cause all the manufacturing steps to be problematic, some air stable compounds thereof are used, which are introduced into the cathode ray tube before its evacuation. In the case of the barium, the stable compound is $BaAl_4$; in the case of calcium, it is possible to use $CaAl_2$ or a ternary alloy Ca—Ba—Al containing between 53% and 56.8% by weight of aluminum, between 36% and 41.7% by weight of calcium and between 1.5% and 11% by weight of barium. These compounds are generally used in mixture with nickel and, in the case of calcium compounds, optionally or alternately with titanium. The ternary alloys are the subject of the Applicant's U.S. patent application Ser. No. 10/282,715, entitled "Device and Method for Producing a Calcium-Rich Getter Thin Film" filed Oct. 29, 2002, which is hereby incorporated by reference for all purposes.

In order to introduce these mixtures into cathode ray tubes, use is normally made of devices known to those skilled in the art as evaporable getters, formed of an upperly open metal container and containing powders of the desired mixture. Evaporable getter devices containing barium are for example described in patents U.S. Pat. Nos. 4,323,818, 4,553,065, 4,642,516, 4,961,040 and 5,118,988, all of which are hereby incorporated by reference. Examples of evaporable getter devices containing a calcium compound which can be cited are those described in international patent application WO01/01436 and in U.S. application Ser. No. 10/282,715 filed Oct. 29, 2002, entitled "Device and Method for Producing a Calcium-Rich Getter Thin Film" in the name of the applicant discussed above.

Once the evaporable getter device has been introduced into the cathode ray tube, the latter is connected to a vacuum pump and brought to the desired final internal pressure, generally lower than $10^{-5}$ hectoPascal (hPa). Finally, the evacuated cathode ray tube is sealed and heated from the outside by radio-frequencies in order to cause metal evaporation from the barium or calcium compound; then, the evaporated metal condenses onto the internal walls of the evacuated tube, thus forming the film active in gas sorption.

However, it is known that metal deposition onto specific areas of the cathode ray tube internal surface can be detrimental for the working of the tube itself or even totally compromise it. In particular, the formation of metal deposits on the screen and on the phosphors must be reduced as much as possible. Also the area between the electron gun (at cathode potential) and the so-called "anode button" must remain free from metal deposits because, as it is known by those skilled in the art, the presence of ionizable particles between two points at different electric charge would cause a short circuit of the system.

In order to prevent such drawbacks, it is possible to use particular measures such as evaporable getter devices provided with very high lateral walls, suitably formed so as to convey the evaporated metal jet onto some areas of the internal surfaces of the cathode ray tube; a getter device of this kind is described in U.S. Pat. No. 4,323,818. However, this method is not completely satisfactory, since the effect of directing the metal vapors is limited.

Alternatively, it is possible to use getter devices comprising deflectors positioned above the powder mixture of the barium or calcium precursor compound. Getter devices of this kind are described, for example, in U.S. Pat. No. 3,719,433. This solution, however, results in an increase of the time and consequently of the costs necessary for manufacturing said devices.

SUMMARY OF THE INVENTION

Therefore, in order to address the above-listed problems, the present invention provides a process for depositing a calcium getter film inside systems that operate under vacuum, which is free from the above-listed drawbacks. This is achieved by a process whose main features are introducing at least one evaporable getter device that has an air-stable calcium compound into the target system, beginning the evacuation of the system until a first pressure is reached, and then heating the evaporable getter device up to the calcium evaporation temperature of the stable compound. Next, the system evacuation continues until a second pressure value, which is lower than the first pressure value, is reached, and then sealing said system.

An advantage of the process according to the present invention is that it allows obtaining a calcium deposit selectively in some areas of the internal surface of the cathode ray tube without the need to adopt the above-mentioned measures in order to convey the evaporated metal.

BRIEF DESCRIPTION OF THE DRAWINGS

Further advantages and features of the process according to the present invention will appear to those skilled in the art from the following detailed description of one embodiment thereof with reference to the accompanying drawings wherein.

DETAILED DESCRIPTION OF THE INVENTION

The process according to the present invention can be applied in order to accomplish calcium evaporation inside any system operating under vacuum, and in one embodiment the invention applies to a cathode ray tube. In the processes previously known to those skilled in the art, wherein barium-based evaporable getter devices are used, evaporation is the last step and is carried out after sealing the system. In contrast, the process of the present invention in a first embodiment is characterized in that calcium evaporation is carried out during the evacuation or between two different evacuation steps, and occurs before sealing the system.

The present invention comprises a first known step wherein at least one evaporable getter device comprising an air stable calcium compound is introduced inside the system. Any known device that uses calcium as a getter element can be used in this process. For example, evaporable getter devices described in the above-cited international patent application WO01/01436 or U.S. patent application Ser. No. 10/282,715 filed Oct. 29, 2002, incorpoated by reference above, can be used. The evaporable getter device must be positioned at about the center of the area wherein the calcium deposit has to be obtained. In the case of a cathode ray tube, the evaporable getter device can be advantageously positioned in the area of the antenna or of the anode button.

Figure 1:
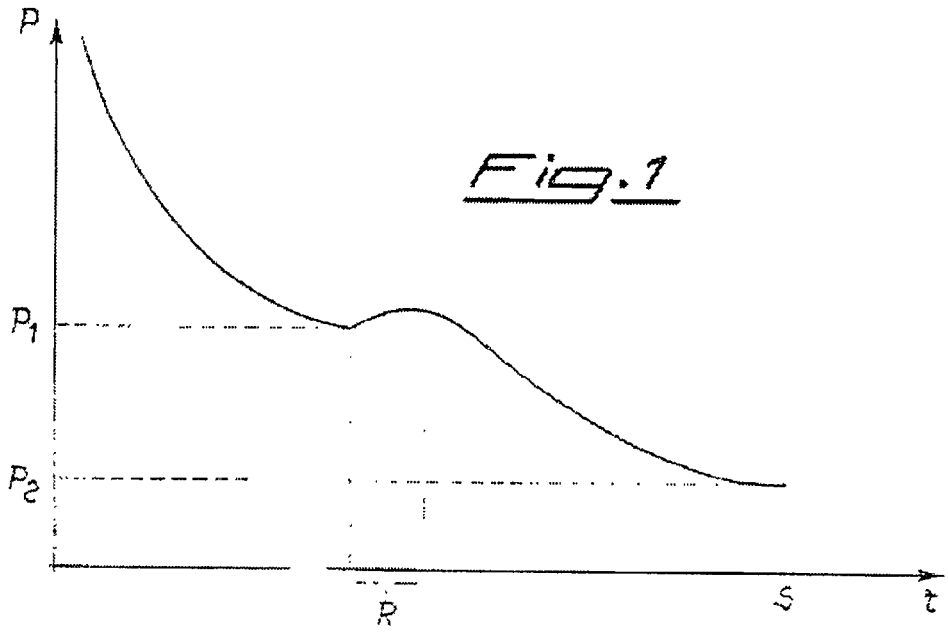
FIG. 1 shows in a graphical form the variation of the internal pressure of the cathode ray tube as a function of time, during some steps of the process according to the present invention in a first embodiment.

As shown in FIG. 1, the process implies then the evacuation of the system with a pump or, more commonly, a pumping group (a system of more pumps of different types). As soon as the pressure indicated in the figure with $P_1$ is reached, which is higher than the final pressure that has to be reached by evacuation, the heating operation of the getter device (indicated with R in FIG. 1) is carried out in order to cause calcium evaporation.

This heating operation is generally carried out by induction by means of a coil arranged outside the system in a position corresponding to that of the device itself. As is well known to those skilled in the art, this step is continued for a predetermined time period, generally between about 30 and 45 seconds. During this step, the gases trapped in the device are released, thus causing the slight pressure increase shown in FIG. 1. Other, more theoretical, ways of performing the heating operation such as laser irradiation can be appreciated by those skilled in the art.

Surprisingly, although none of the known measures for conveying the evaporated metal have been adopted, a diffusion of calcium atoms in all the internal space of the system does not take place during said evaporation step. Instead evaporated calcium atoms begin their diffusion inside the system, but they are "reflected" back by way of the collision with the molecules of the atmospheric gases or those released by the getter device itself during the evaporation. In this way, the presence of gases inside the system has the effect of preventing the deposit of the calcium atoms in undesired areas, such as the screen area or between the electrodes in the case of a cathode ray tube. Instead, under these conditions calcium atoms are deposited almost exclusively in the area adjacent to where the evaporable getter device was first arranged, for example, in the case of a cathode ray tube, near the antenna or the anode button. The calcium evaporation step takes place at a temperature, as can be appreciated by those skilled in the art, at which reactions are caused between the titanium or nickel and the stable calcium compounds which displace the calcium from the bonds in the stable compound, and allow the calcium to be scattered or "evaporated." The Ca is more easily ready for evaporation because of the reduced pressure. In a preferred embodiment, this temperature is around between 600 and 1000 degrees Centigrade with the use of titanium and a CaAl compound. But as can be appreciated by those skilled in the art, this temperature may vary greatly based on manufacturing conditions and the heating method, and such a temperature is provided as an example and not as a limitation.

As stated above, pressure $P_1$ must have a higher value than that of the internal pressure $P_2$ at which the system works, but lower than the air pressure that would be sufficient for causing inactivation of the calcium which will be evaporated in the course of the subsequent heating step. The situation is to be avoided where the particles of atmospheric gases remain in the system and may completely saturate the newly formed getter deposit, making it unavailable for gas sorption in the course of the functioning of the system. It has been experimentally verified that pressure $P_1$ works best between about $10^{-4}$ and $10^{-5}$ hPa in a preferred embodiment.

Evacuation is then continued until the pressure value of $P_2$ is reached, generally between $10^{-5}$ and $10^{-6}$ hPa, at which time the system is sealed (the step indicated by S in FIG. 1).

Figure 2:
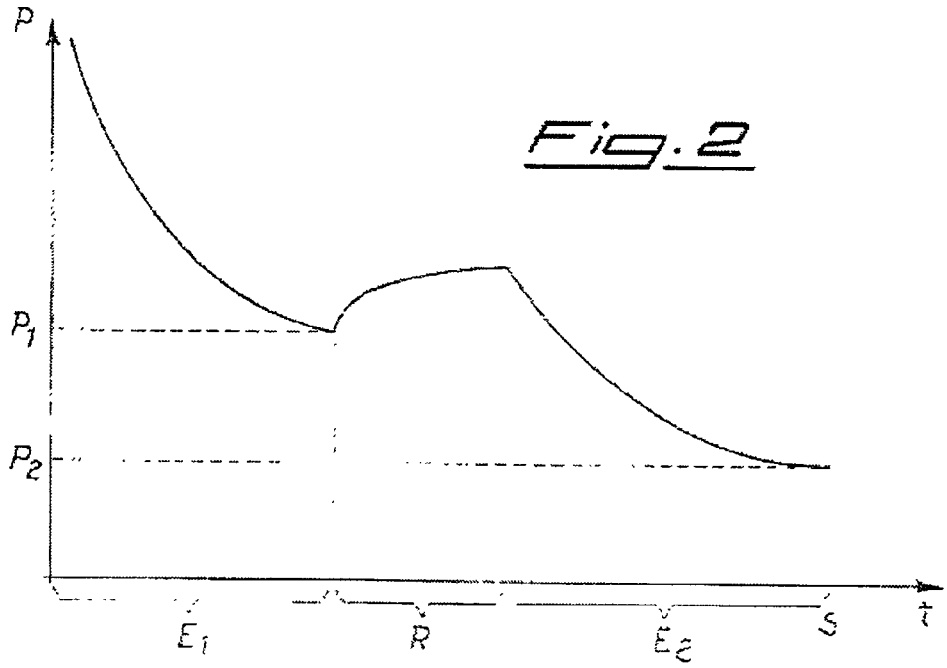
FIG. 2, which is similar to FIG. 1, shows the variation in time of the pressure in the preferred embodiment of the invention during some steps of the process.

In a preferred embodiment of the process according to the invention, during step R, the evacuation is interrupted by isolating the system from the pumping group with suitable valves. Referring now to FIG. 2, the process in the preferred embodiment of the inventive process is shown. In this embodiment, the process includes (in addition to the introduction of the getter device in the system and the final sealing) three main steps: a first evacuation step, $E_1$, wherein the pressure is brought to the value $P_1$; the heating step R of the getter device for causing calcium evaporation, during which the system is isolated from the pumping group by means of suitable valves; and a second evacuation step, $E_2$, carried out by opening said valves again, and in which the pressure in the system is reduced to the value $P_2$ at which the sealing S is carried out. In this last step, $E_2$, a major part of the gases emitted by degassing during step R is eliminated. This embodiment is preferred because, by interrupting the pumping during step R, there is a pressure increase due to the degassing of the internal components of the tube, which contributes to the "back scattering" effect of the evaporated calcium atoms. The pressure values $P_1$ and $P_2$ in this embodiment are generally the same as previously indicated in the first embodiment, discussed above.

The residual pressure reduction, a final pressure value of about $10^{-7}$ hPa, which is necessary for the correct operation of systems such as a cathode ray tube, is to be carried out by the obtained calcium film.

The process of the invention is not applicable in the case of the barium getter devices because this element has a much larger mass than that of calcium (more than three times) and barium "back scattering" by the gas molecules would only be possible at much higher pressure values, higher than about $10^{-2}$ hPa. In these conditions, the just-formed barium film would be soon spent by the sorption of the great gas quantity, thus being ineffective for maintaining the vacuum during the life of the cathode ray tube.

Possible variations and/or additions can be made by those skilled in the art to the described and illustrated embodiment, by remaining within the scope of the invention itself. For example, the evaporable getter material can be introduced in the system by means of any open container that can be arranged in a defined position inside the system itself.

We claim:

1. A method for depositing a calcium getter thin film, comprising:

introducing into a system, a getter device containing an air-stable calcium metal-alloy compound, evacuating said system until a first pressure value is reached wherein said first pressure value is between about $10^{-4}$ and $10^{-5}$ hPa;

heating the evaporable getter device in said system to a temperature at which calcium is displaced from said stable calcium-metal alloy compound;

evacuating said system until a second pressure value is reached, said second pressure value being lower than said first pressure value; and sealing said system after said second pressure value is reached.

2. The method as recited in claim 1, wherein said evacuation step includes two separate substeps: a first substep until said first pressure value is reached and a second substep until said second pressure value is reached, said two evacuation substeps being separated by said heating step.

3. The method as recited in claim 2, wherein said system is isolated from vacuum pumping before said heating step is performed.

4. The process recited in claim 2, wherein said stable calcium-alloy compound is $CaAl_2$ or a ternary alloy Ca—Ba—Al containing between 53% and 56.8% by weight of aluminum, between 36% and 41.7% by weight of calcium and between 1.5% and 11% by weight of barium.

5. A process according to claim 4, wherein said stable calcium-alloy compound is in mixture with nickel or titanium.

6. The process recited in claim 1, wherein said stable calcium-alloy compound is $CaAl_2$ or a ternary alloy Ca—Ba—Al containing between 53% and 56.8% by weight of aluminum, between 36% and 41.7% by weight of calcium and between 1.5% and 11% by weight of barium.

7. The process according to claim 6, wherein said stable calcium-alloy compound is in mixture with nickel or titanium.

8. The process recited in claim 1, wherein said system is a CRT.

* * * * *